US005299442A

United States Patent [19]

Graham

[11] Patent Number: 5,299,442

[45] Date of Patent: Apr. 5, 1994

[54] RIVNUT (TM) INSTALLATION APPARATUS

[76] Inventor: Gary A. Graham, Box 2000, Glacier, Wash. 98244

[21] Appl. No.: 110,225

[22] Filed: Aug. 23, 1993

Related U.S. Application Data

[63] Continuation-in-part of Ser. No. 2,049, Jan. 8, 1993.

[51] Int. Cl.[5] ..... B21J 15/10

[52] U.S. Cl. ..... 72/391.8; 72/114; 29/524.1

[58] Field of Search ..... 72/114, 391.4, 391.8; 29/524.1

[56] References Cited

U.S. PATENT DOCUMENTS

| | | | |
|---|---|---|---|
| 2,384,347 | 9/1945 | Schutz | 72/114 |
| 2,445,067 | 7/1948 | Hiler | 72/114 |
| 2,583,733 | 1/1952 | Fischer et al. | 72/114 |
| 4,559,806 | 12/1985 | Schwab | 72/391 |
| 4,821,555 | 4/1989 | Kamata et al. | 72/391 |

*Primary Examiner*—David Jones

*Attorney, Agent, or Firm*—Robert W. Jenny

[57] ABSTRACT

The apparatus comprises a frame and a carriage mounted slidably on the frame. The frame has a work support part and the carriage is equipped with a fastener, the threaded end of which extends through a hole in the work support part. A jack is situated between one member attached to the frame and another on the carriage. Extension of the jack moves the carriage on the frame to retract the fastener part way into the hole in the work support part. Tension springs, connected between a part attached to the frame and another on the carriage serve to restore the carriage to its at rest position relative to the frame when the jack is not extended. A flywheel is mounted on a shaft which engages the head of the fastener. In use a RIVNUT (TM) is threaded onto the fastener, the shank of the RIVNUT (TM) is inserted through a hole in the work (or the work part is placed onto the RIVNUT (TM)), the jack is extended to collapse the RIVNUT (TM) shank and thus install the RIVNUT (TM) and the flywheel is spun to withdraw the fastener from the RIVNUT (TM).

1 Claim, 2 Drawing Sheets

RIVNUT (TM) INSTALLATION APPARATUS

The subject application is a Continuation-In-Part application based on application Ser. No. 002,049, filed Jan. 8, 1993.

BACKGROUND OF THE INVENTION

1. Field

The subject invention is in the field of apparatus for installing rivets and other fasteners which are held in place by deforming them after they are in place in material to be fastened or fastened to. It is also in the field of apparatus used for installing parts of fastener apparatus, such as the internally threaded portions of threaded fasteners, by deformation of the parts after they are in place in one of the parts to be fastened. In particular the invention is in the field of apparatus used for installing fastener parts known in the trade as RIVNUTS (TM).

2. Prior Art

There are several types of commercially available apparatus for installing RIVNUTS (TM). It has been the subject inventor's experience that those apparatuses suitable to his production needs in terms of quantity of output and of cost proved to be not sufficiently durable or reliable or to not have adequately predictable performance, especially for installing steel RIVNUTS (TM), as different from aluminum RIVNUTS (TM). Also, commercially available prior art apparatus in this field was found to be more complicated and expensive than were appropriate for low to moderate production rate work. The following U.S. Pat. Nos. illustrate such prior art apparatus.

2,445,067
4,599,086
2,583,733
4,821,555

Accordingly, the prime objective of the subject invention is to provide a reliable, inexpensive, less complicated, easy to operate apparatus for relatively quick installation of RIVNUTS (TM), particularly steel RIVNUTS (TM).

SUMMARY OF THE INVENTION

The subject invention is apparatus for installing RIVNUTS (TM). RIVNUTS (TM) are flanged tubes with internal threads in the tube end opposite the flanged end. They are installed in sheet material by inserting the tube through a hole in the material until the flange contacts the material firmly, engaging the internal threads by threads on a rod inserted into the tube from the flanged end and then pulling on the rod while restraining the flange to cause the unthreaded portion of the tube to collapse and bulge outwardly to clamp the sheet material between the flange and collapsed portion. The pulling rod is then threaded out of the RIVNUTS (TM), leaving it ready for engagement with a threaded fastener used to attach a suitable item to the sheet material.

The subject apparatus comprises a flat work surface on a work support part. The support part is supported by two columns, preferably tubes or cylindrical rods, from a base. A threaded fastener extends through a hole in a replaceable guide in the work support part to engage a RIVNUT (TM) for installation. The threaded fastener is rotatably installed in a bushing which is inserted into a first end of a carriage which is slidably mounted on the columns which support the work support part. The carriage comprises the first end member and a second end member interconnected and held parallel to each other by two parallel cylindrical parts, preferably rods. The second end member has holes which allow it and the carriage to slide on the columns and the rods slide in holes in a cross member which is parallel to the work support member and attached to the columns. There are two tension springs attached between the cross member and the second end of the carriage, tending to move the carriage toward the work support part. A hydraulic jack is installed between the second end of the carriage and the cross member. Extending the jack moves the carriage against the force of the springs to move the carriage away from the work support part, thus pulling the threaded fastener through the hole in the guide in the work support part as needed to install a RIVNUT (TM) in place in a hole in material supported on the work support part.

A flywheel is mounted on a shaft, one end of which is carried in a bearing mounted in a second cross member which is mounted on the rods of the carriage. The other end of the shaft is hexagonally shaped in cross section and engages either the hex socket in the head of the threaded fastener or a hex socket in an adaptor which in turn engages the hex socket in the threaded fastener. The axis of the shaft is coincident with that of the fastener.

In use, a RIVNUT (TM) is threaded onto the fastener, a work piece is placed over the RIVNUT (TM), and the hydraulic actuator is extended, causing the carriage to move away from the working surface part, thus applying tension to the fastener and collapsing the RIVNUT (TM) into its installed configuration. The flywheel is then spun manually to disengage the fastener from the installed RIVNUT (TM).

RIVNUTS (TM) are available in a range of sizes, requiring a range of sizes of fasteners for their installation. This range of sizes of fasteners is accommodated in the subject apparatus by provision of a range of sizes of fastener holding bushings and a corresponding range of sizes of fasteners and adaptors one size of each for each bushing size for each RIVNUT (TM) size. Also, an anvil may be fitted to the working part to enable installing RIVNUTS (TM) in recesses and the like. To change bushings, adaptors and fasteners the attachments of the second crossmember to the rods are loosened and the crossmember, shaft and flywheel are moved along the rods to provide clearance for removing and replacing the threaded fastener and associated bushing adaptor (if any) and guide.

The invention is described in more detail below with reference to the attached drawings.

DETAILED DESCRIPTION OF THE INVENTION

Figure 1:
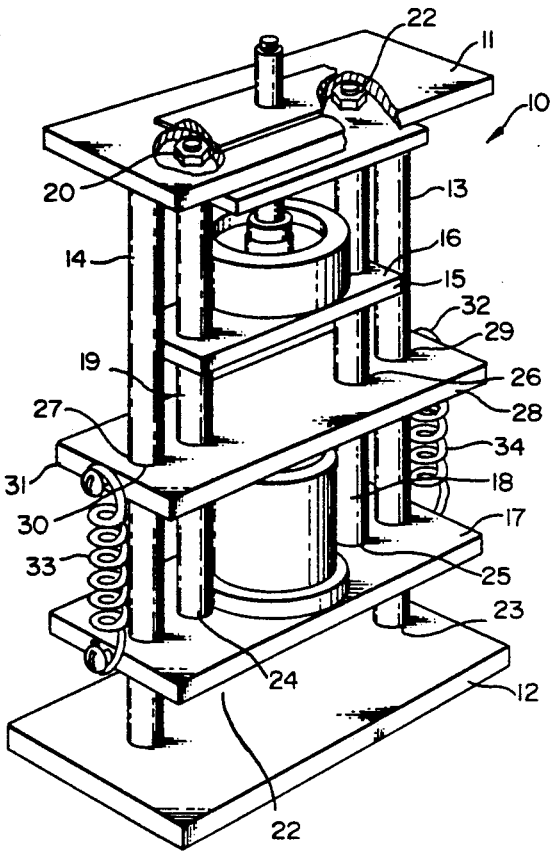
FIG. 1 is a perspective view of the subject apparatus.

The subject invention is apparatus for installing RIVNUTS (TM) in sheet material. For purposes of this disclosure the term sheet material means any flat, thin portion of an object. FIG. 1 is a perspective view of the apparatus 10 which comprises a work support part 11 supported from base 12 by columns 13 and 14. Carriage 15 is slidably mounted on the columns and comprises first end 16 and second end 17 interconnected by rods 18 and 19 and nuts 20, 21, 22, and 23. Holes 24 and 25 in end 17 fit on the columns and the rods slide in holes 26 and 27 in crossmember 28 which is attached to the columns with the columns through holes 29 and 30 with screws 31 and 32 holding it in place on the columns. Tension springs 33 and 34 are connected to the crossmember 28 and second end 17, thus tending to move the carriage toward the working surface part and motion in that direction is limited by hydraulic jack 35 installed between end 17 and member 28.

Figure 2:
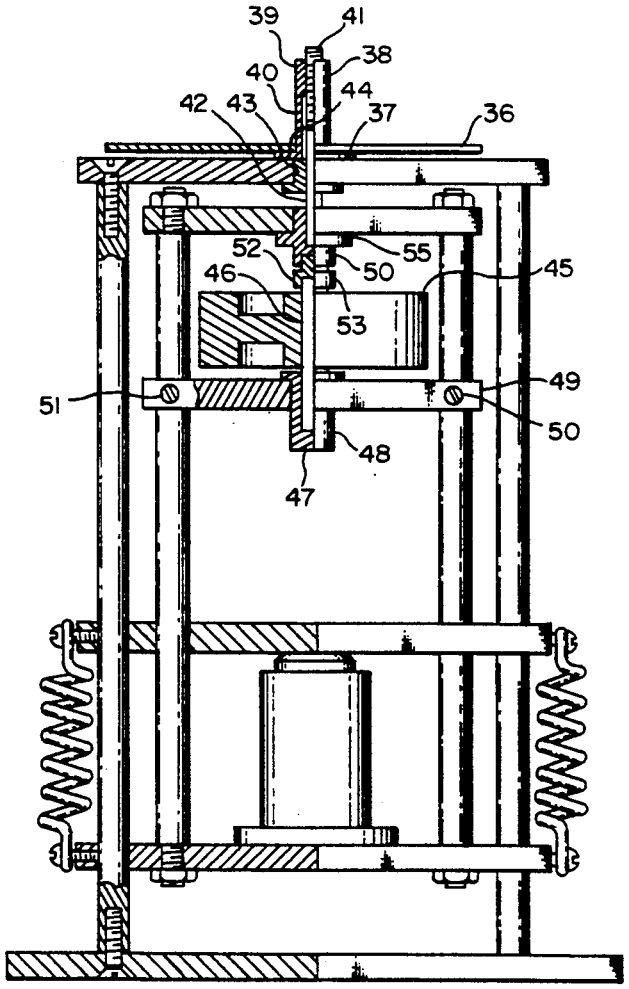
FIG. 2 is a sectional view of the apparatus taken at 2—2 in FIG. 1 with a RIVNUT (TM) ready for installation.

FIG. 2 is a sectional view of the apparatus taken at 2—2 in FIG. 1. This view illustrates a work piece 36 placed over flange 37 of RIVNUT (TM) 38. Threaded portion 39 of the tubular shank 40 of the RIVNUT (TM) is engaged by the threads of fastener 41. The non-threaded portion 42 of the fastener rotates in hole 43 in guide 44. The guide is inserted into work support part 11. Alternate guides are used to accommodate other sizes of fasteners to suit other sizes of RIVNUTS.

Flywheel 45 is mounted on shaft 46. End 47 of the shaft is carried in bearing 48 which is supported in crossmember 49. Member 49 is slidably mounted on the carriage rods and adjustably fixed in place on the rods by set screws 50 and 51. End 52 of the shaft has a hexagonal cross section which engages either the hex shaped socket in the fastener or a hex socket in adaptor 53 which has a hexagonally shaped portion 54 which engages the hex socket in the fastener. The fastener extends through bushing 55 in the first end member of the carriage. Set screws 50 and 51 are loosened to allow member 49 to slide along the rods along with the shaft mounted flywheel to provide clearance for interchanging various sizes of the bushing 55, guide 44, adaptor 53 and the fastener.

In use of the apparatus, a RIVNUT (TM) is threaded onto the fastener, the RIVNUT (TM) is inserted in a hole in the work piece (either by placing the work piece on the apparatus or, with the apparatus made portable, inserting the RIVNUT (TM) through a hole in the work piece), the actuator is caused to extend, forcing the carriage away from the work support piece and deforming the RIVNUT (TM) to fasten it in place, the actuator is allowed to relax, the spring moves the carriage to its at rest position and the flywheel is manually spun to remove the fastener from the RIVNUT (TM).

Figure 3:
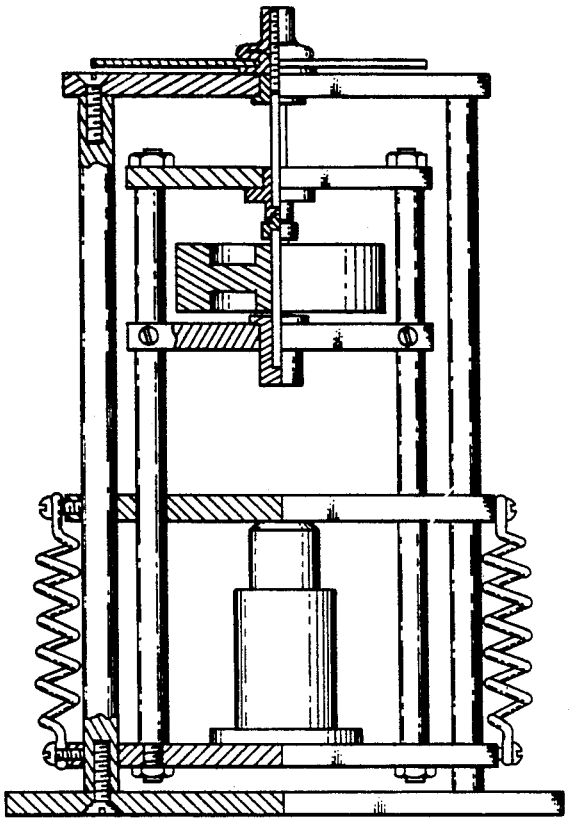
FIG. 3 is similar to FIG. 2 but with the RIVNUT (TM) installed.
Figure 4:
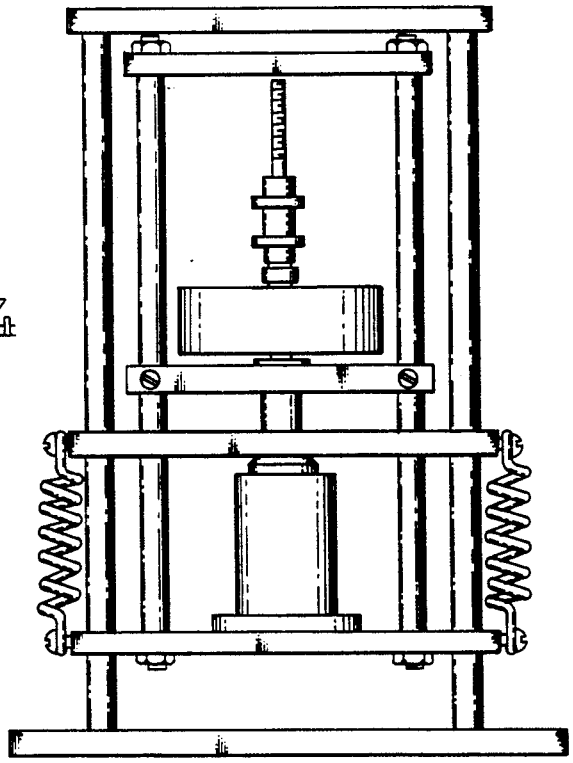
FIG. 4 is a plan view of the subject apparatus set for exchanges of the fastener, guide, adaptor and bushing.

FIG. 3 is a section view similar to FIG. 2 but with the carriage moved to deform the RIVNUT (TM). FIG. 4 is a view showing the crossmember of the carriage set for exchange of the fastener, the guide, the adaptor and the bushing, as needed to work with the various sizes of RIVNUTS (TM).

It is considered to be clear from this description that the subject invention meets its prime objective. Because of its simplicity and construction with rugged parts and the use of the flywheel to remove the fastener, it provides a reliable, uncomplicated, inexpensive, easy to, operate apparatus for relatively quick installation of RIVNUTS (TM), particularly steel RIVNUTS (TM) which require considerably more force to install than do aluminum RIVNUTS (TM).

It is also considered to be understood that while one embodiment of the invention is described herein, other embodiments and modifications of the one described are possible within the scope of the invention which is limited only by the attached claims.

I claim:

1. Apparatus for installing a RIVNUT (TM) in a hole in a work piece, said RIVNUT (TM) having a flange, said apparatus comprising:

a frame having a work support surface, a hole in said work support surface and at least one part attached to said frame, carriage slidably mounted on said frame, a shaft, a flywheel mounted on said shaft and a rotatably mounted threaded fastener, all mounted on said carriage with said fastener rotatable by said shaft and said flywheel, a jack mounted between said carriage and said at least one part attached to said frame, at least one spring mounted between said frame and said carriage such that the force applied by said at least one spring opposes extension of said jack, said threaded fastener extending through said hole in said work support part, whereby said RIVNUT (TM) is installed in said work part threading said RIVNUT (TM) onto said fastener with said flange against said work support part, inserting said RIVNUT (TM) through said hole in said work part and extending said jack to move said carriage, thus applying tension force to said fastener to collapse said RIVNUT (TM) to fasten it to said work piece and whereby said fastener is then removed from said RIVNUT (TM) by spinning said flywheel to rotate said fastener.

* * * * *